US010392165B2

(12) United States Patent
DeCarlo et al.

(10) Patent No.: US 10,392,165 B2
(45) Date of Patent: Aug. 27, 2019

(54) METHOD FOR SEALING MATERIALS

(71) Applicant: Process4, Inc., Chagrin Falls, OH (US)

(72) Inventors: Anthony DeCarlo, Chagrin Falls, OH (US); Lisa Brady, Chagrin Falls, OH (US); Curtis Taylor, Chagrin Falls, OH (US); Matthew Hanson, Chagrin Falls, OH (US)

(73) Assignee: IdeaStream Consumer Products, LLC, Cleveland, OH (US)

( * ) Notice: Subject to any disclaimer, the term of this patent is extended or adjusted under 35 U.S.C. 154(b) by 629 days.

(21) Appl. No.: 15/051,868

(22) Filed: Feb. 24, 2016

(65) Prior Publication Data

US 2016/0244216 A1 Aug. 25, 2016

Related U.S. Application Data

(60) Provisional application No. 62/120,490, filed on Feb. 25, 2015.

(51) Int. Cl.
*B65B 7/28* (2006.01)
*A45C 11/20* (2006.01)
(Continued)

(52) U.S. Cl.
CPC ..... *B65D 43/22* (2013.01); *A45C 11/20* (2013.01); *A45C 13/008* (2013.01);
(Continued)

(58) Field of Classification Search
CPC ..... B65B 7/26; B65B 7/2842; B65D 43/162; B65D 43/164; B65D 43/169; B65D 43/22;
(Continued)

(56) References Cited

U.S. PATENT DOCUMENTS 5,366,104 A 11/1994 Armstrong
5,526,953 A * 6/1996 Chieng ..... A45C 13/008 206/387.1
(Continued)

FOREIGN PATENT DOCUMENTS

DE 8108459 7/1981
FR 2827579 A3 * 1/2003 ..... A45C 11/20
(Continued)

OTHER PUBLICATIONS

European Search Authority, Extended European Search Report for corresponding EP App. No. 16000457.8 (dated Jun. 21, 2016).

*Primary Examiner* — Stephen F. Gerrity
(74) *Attorney, Agent, or Firm* — Fay Sharpe LLP

(57) ABSTRACT

A container that includes a container body and a securely attached container lid. The container lid can form an airtight and/or liquidtight seal between the container lid and the container body when the container lid is in the fully closed position and locked position. The container lid is attached to the container body by a hinge. The container lid includes a seal member, cover window portion, and an outer rim portion having a plurality of lid latches. The latches are configured for movement between an unlatched position in which the container contents can be accessed and a latched position in which latch features engage fastening members to secure the container lid in the fully closed and locked position to the container body.

21 Claims, 8 Drawing Sheets

(51) Int. Cl.
*A45C 13/00* (2006.01)
*B65D 43/16* (2006.01)
*B65D 43/22* (2006.01)
*B65D 45/20* (2006.01)

(52) U.S. Cl.
CPC ..... *B65B 7/2842* (2013.01); *B65D 43/16* (2013.01); *B65D 43/169* (2013.01); *B65D 45/20* (2013.01); *B65D 2543/0024* (2013.01); *B65D 2543/00027* (2013.01); *B65D 2543/00101* (2013.01); *B65D 2543/00296* (2013.01); *B65D 2543/00314* (2013.01); *B65D 2543/00564* (2013.01); *B65D 2543/00657* (2013.01)

(58) Field of Classification Search
CPC ..... B65D 45/20; A45C 11/20; A45C 13/005; A45C 13/008
USPC ..... 220/324, 837, 839, 845
See application file for complete search history.

(56) References Cited

U.S. PATENT DOCUMENTS 5,938,068 A 8/1999 Atkins et al.
7,080,754 B2 * 7/2006 Lown ..... B65D 43/164 220/324
7,621,417 B2 * 11/2009 Peterson et al. ... B65D 43/0212 220/254.3
8,733,550 B2 * 5/2014 Harvey et al. ..... B65D 41/16 206/508
9,827,730 B2 * 11/2017 Smyers ..... B65D 45/22
2004/0118848 A1 * 6/2004 Marshall ..... B65D 43/169 220/266
2004/0159661 A1 * 8/2004 Aochi ..... B65D 25/2811 220/264
2005/0006390 A1 1/2005 Wang
2006/0021889 A1 2/2006 Kim
2009/0032545 A1 * 2/2009 Zeiler et al. ..... B65D 43/169 220/833
2009/0289066 A1 * 11/2009 DiPietro et al. ... B65D 43/0212 220/324
2010/0308055 A1 12/2010 Sams
2011/0127264 A1 * 6/2011 Whalen ..... A45C 5/03 220/203.01
2011/0315701 A1 * 12/2011 Everson ..... B65D 43/162 220/780
2012/0012602 A1 1/2012 Everson
2012/0024856 A1 2/2012 Smyers
2012/0248116 A1 * 10/2012 Smyers et al. ..... B65D 45/20 220/324
2015/0014319 A1 * 1/2015 Norris ..... B65D 41/02 220/324
2015/0014320 A1 * 1/2015 Koo ..... B65D 45/20 220/324

FOREIGN PATENT DOCUMENTS

GB 535392 A * 4/1941 ..... B65D 45/20
WO 2011142542 11/2011
WO WO-2012015316 A1 * 2/2012 ..... A45C 11/20

* cited by examiner

METHOD FOR SEALING MATERIALS

The present invention claims priority to U.S. Provisional Application Ser. No. 62/120,490, filed on Feb. 25, 2015, and is fully incorporated herein.

The present invention is directed to a sealable container that has a lockable container lid. The invention finds particular application in conjunction with food storage, and will be described with particular reference thereto. However, it is to be appreciated that the present invention is also amenable to other applications (e.g., general storage, etc.).

BACKGROUND OF THE INVENTION

A variety of different types of containers are available for general storage use, some of which are particularly designed for the storage and preservation of food items for later consumption and/or use. These containers may be intended for commercial use during the distribution of food items, home use for the storing of recently prepared food items, or both.

Rigid containers are preferable as they are durable, can maintain their shape, and thereby protect the stored items (e.g., food items, etc.) from being crushed. Another advantage is that the rigid containers are usually easily washable and, therefore, reusable. Also, it is desirable that rigid containers be temperature and microwave resistant to allow for heating, cooling, and freezing of the stored food items within the container.

These containers, such as bowls for food items and the like, have sometimes been provided with lids. However, the container/lid combinations have typically been susceptible to leakage, or difficulties in securing the lid to the container. This problem of securing the lid to the container can be aggravated after the container and lid have been washed and dried by heat, which can result in slight deformations of the container and/or lid. Such container/lid combinations, as a result of slight deformation, can lose their ability to generate a tight seal between said lid and container.

It would be desirable to provide a storage container and lid combination that can be used to form an airtight, lockable, leak-proof seal, be a microwavable container, and which lid can be repeatedly and releasably securable to the container after being subjected to many wash and dry cycles.

SUMMARY OF THE INVENTION

The present invention relates to a storage container adapted and designed to provide a locking mechanism that can be used in the storing and preserving of foodstuffs. The lockable container of the present invention overcomes the limitations of generic container/lid combinations that have typically been susceptible to leakage, or difficulties in securing the lid to the container, especially after having been repeatedly washed and dried.

The present invention is directed to a container that incorporates an airtight lid system and a locking mechanism suitable for use with the storage of food items; however, it can be appreciated that the lockable container can be configured to store other objects (e.g., office supplies, hardware, pet foods, liquid products, etc.). According to one non-limiting aspect of the present invention, the lockable container comprises a container body and a container lid that is connected to the container body; however, this is not required. The container lid can be permanently and/or securely connected to the container body, or can be removably connected to the container body.

In another and/or alternative non-limiting aspect of the present invention, the container lid can incorporate a lid system which can include an outer rim portion and a cover portion, wherein a plurality of lid latches are connected to the outer rim portion by hinge arrangements (e.g., living hinges, etc.). The plurality of lid latches can be configured to lock the container lid to the container body when in a closed position. The plurality of lid latches can be configured for movement between an unlatched position in which the container lid, when previous connected to the container body, can be removed from an opening in the container body to allow access to the interior of the container body, and a latched position in which the lid latches can engage fastening members located on the container body so that the container lid can be secured over an opening in the container body and provide a seal over the opening in the container body. A seal member can optionally be provided between the outer rim portion and the cover window portion for the purpose of creating an airtight and/or leak-proof seal; however, this is not required.

In another and/or alternative non-limiting aspect of the present invention, the container can include a container lid permanently and/or securely attached to the container body by a living hinge. The container lid can include one or more moveable pieces that can be used to secure and seal the container lid to the container body. In still yet another and/or alternative non-limiting aspect of the present invention, the container lid can create an airtight and liquidtight system when in the closed and locked/latched position.

In another and/or alternative non-limiting aspect of the invention, the container lid and living hinge can be formed in a one-piece construction as one component of the container. Similarly, the container body can be formed in a one-piece construction and the container lid can be constructed as a second component of the container. As such, the container can be manufactured as two separate components. In such an arrangement, the container lid and container body can be configured such that the container lid can be hingedly connected to the container body such that the container lid is no long intended to be separated from the container body during the use of the container lid with the container body. One non-limiting arrangement can include a snap fit connection wherein the container lid includes a hinge having connection members that are designed to snap into openings in the rim or side of the container body and, once connected, the connection members are not designed to be releasable from the openings in the rim or side of the container body; however, this is not required. As can be appreciated, the hinge on the container lid can include one or more openings and the rim or side of the container body can include connection members, or both the hinge of the container lid and the rim or side of the container body can include connection members and/or openings. As can also be appreciated, the container body can include the hinge that is to be connected to the container lid, or both the container lid and the container body include a portion of the hinge that is to be connected together. As can further be appreciated, other or additional arrangements can be used to hingedly connect the container lid to the container body such that the container lid is not intended to be fully disconnected from the container body for any reason after the container lid is initially connected to the container body. As can be appreciated, the connection between the container lid and container body can be permanent; however, it can be appreciated that the container lid can be configured to be disconnected from the container body after the container lid is initially connected to the container body. One non-limiting advantage of manufacturing the container as two separate components prior to a first use is an increased ease of shipping and manufacturing processes of the container body and the container lid.

In another and/or alternative non-limiting aspect of the invention, the container body can be substantially bowl-shaped with an open end at the top of the container such that one or more sidewalls extend upwardly from a bottom wall thereby forming the bowl-shaped body of the container. The bowl shape of the container body can define and provide a storage cavity for receiving foodstuffs, for example; however, this is not required. As can be appreciated, the lockable container can comprise other and/or alternative shapes (e.g., rectangular, circular, etc.). The container body can also include more than one opening; however, this is not required. The opening in the container body can be one the side or partially formed in the top or side of the container body, formed in the bottom of the container body, or some other location on the container body. The one or more sidewalls can be marginally continuous through the corners along a longitudinal end; however, this is not required. Generally, the container body can include at least two sidewalls, more typically at least three sidewalls, and even more typically four sidewalls; however, this is not required. As can be appreciated, the container body can include more than four sidewalls or less than four sidewalls depending on the design and look desired and/or needed for the container. The one or more sidewalls can form an interior and exterior sidewall surface. Generally, the container body is of a one-piece construction; however, this is not required. The materials used to form the container body are non-limiting. In one non-limiting arrangement, the container body is formed of a durable plastic material. The material used to form the container body can be clear, semi-clear or opaque. The container body can be manufactured by a variety of processes (e.g., molded, blow molded, extruded, stamped, formed by 3D printing, etc.).

In another and/or alternative non-limiting aspect of the invention, the container body includes four sidewalls, wherein two oppositely disposed sidewalls extend between the other two oppositely disposed sidewalls, wherein all four sidewalls are continuous through the corners; however, this is not required. The four sidewalls and the base wall can be marginally continuous through the corners and be formed of as one component; however, this is not required. In yet another and/or alternative non-limiting aspect of the invention, the sidewalls of the container can be bowed radially outward such that the entire perimeter of the container body is curved (i.e., no straight edges exist around the perimeter of the container body); however, this is not required. As can be appreciated, other configurations can be used (e.g., straight sidewalls, curved sidewalls, etc.). In still yet another non-limiting aspect of the invention, the four sidewalls can taper outward from each other when moving away from the base or base portion of the container body such that the top open end of the container body is larger than the area of the base of the container body; however, this is not required. In one non-limiting embodiment of the invention, at least one sidewall may optionally include markings and/or labels (e.g., volume markings and/or labels, product markings and/or labels, etc.); however, this is not required.

In another and/or alternative non-limiting aspect of the invention, the container body can include a top flange extending continuously perpendicularly away or at some other angle away from the sidewall at its distal end; however, this is not required. The top flange (when used) can provide a top peripheral surface, wherein the distal end of the top peripheral surface can again extend continuously perpendicularly or at some other angle in a descending sidewall portion having a terminal edge; however, this is not required. Thus, the top edge of the container body sidewalls can optionally comprise a substantially U-shaped structure and provide a sealing lip for attachment of container lid latches; however, this is not required. In such an arrangement, the descending sidewall portion can be spaced from the one or more container body sidewalls, thereby defining a gap between the descending sidewall portion and the adjacent container body sidewall; however, this is not required. The descending sidewall portion can extend at least partially over the container body sidewall; however, this is not required. In one some non-limiting embodiment, one or more spaced ribs can be optionally provided between the one or more sidewalls of the container body and the descending sidewall of the peripheral flange; however, this is not required. The use of one or more rib features can be used to provide improved strength and rigidity at the open end of the container body; however, this is not required.

In another and/or alternative non-limiting aspect of the invention, the top peripheral surface of the container body can optionally include a groove and/or channel; however, this is not required. In one non-limiting embodiment, the channel portion is generally V-shaped and designed to receive a sealing member provided on the container lid when the container is in the closed position; however, this is not required. As can be appreciated, the shape of the channel can be many other shapes (e.g., square, rectangular, triangular, U-shaped, C-shaped, V-shaped, etc.). The channel and the sealing member could also be reversed such that the sealing member is on the container body and the channel is in the container lid.

In yet another and/or alternative non-limiting aspect of the invention, the container body can be formed as a one-piece construction wherein all edges and sides are formed marginally continuous through the corners with one another; however, this is not required. In still yet another and/or alternative non-limiting aspect of the invention, the container body, the living hinge, and the outer rim portion of the container lid can be formed into a one-piece construction; however, this is not required. The one-piece construction can be formed by injection molding, for example; however, this is not required.

In another and/or alternative non-limiting aspect of the invention, the container can include one or more living hinges, wherein the one or more living hinges allow the container lid to pivot relative to the container body between the open position and the closed position; however, this is not required. The one or more hinges can connect the container body to the container lid and can comprise one or more pivot points or pivot grooves. In one specific embodiment, the hinge connecting the container lid to the container body typically includes two pivot points or pivot grooves; however, this is not required. When two pivot points or pivot grooves are used, a non-limiting advantage is provided wherein all or substantially all of the container lid can close flat onto the container body simultaneously thereby, improving the seal between the container lid and container body. In yet another and/or alternative non-limiting aspect of the invention, the living hinge permanently and/or securely attaches the container lid to the container body; however, this is not required. Permanent and/or secure attachment of the container lid to the container body can prevent the recurring problem of misplacing the container lid relative to the container body. In one non-limiting embodiment, a first end of the living hinge (when used) can connect to the container body and a second end of the living hinge can connect to the container lid, thereby permanently and/or securely attaching the container lid to the container body. In yet another and/or alternative non-limiting embodiment, a first end of the living hinge can connect to the terminal end of the descending sidewall of the container body and a second end of the living hinge can attach to atop edge of the outer rim portion of the container lid; however, this is not required. In still yet another and/or alternative non-limiting embodiment, one end of the living hinge can attach to the bottom edge of the outer rim portion of the container lid; however, this is not required. As can be appreciated, one end of the living hinge can be attached at a point on the outer surface of the outer rim portion of the container lid between the top edge and the bottom edge, for example, the center of the outer rim portion; however, this is not required.

In another and/or alternative non-limiting aspect of the invention, the container includes a container lid system. The top surface of the container lid can be substantially planar and can be defined by an outer rim portion and a center window separated by a sealing member; however, this is not required. In one non-limiting embodiment, the container lid system can comprise a channel configured to receive and accommodate the top edge of the container body when the container body and container lid are in an at least partially closed position; however, this is not required. The shape of the channel is non-limiting (e.g., U-shaped, C-shaped, V-shaped, etc.). In one non-limiting configuration, the container lid includes a cover window portion and an outer rim portion separated by a sealing member; however, this is not required. The outer rim portion of the container lid can form an interior and exterior outer rim surface; however, this is not required. The lid can be shaped so as to fit the size of the opening provided by the container body; however, this is not required. The container lid can be formed of a plurality of materials; however, this is not required. In one non-limiting arrangement, the sealing member on the container is formed of a different material than the cover window portion and/or the outer rim portion of the container lid. The sealing material can optionally be formed of a material that is more flexible and/or softer than the material used for the cover window portion and/or outer rim portion of the container lid. In another non-limiting arrangement, the material used to form the cover window portion and the outer rim portion of the container lid is the same.

In another and/or alternative non-limiting aspect of the invention, the sealing member can be configured to seat in the channel provided on the top peripheral surface of the container body when the lockable container is in an at least partially closed position; however, this is not required. As can be appreciated, an opposite configuration can be used. The sealing member can be adapted and/or designed to have an inverse shape as the channel portion such that the channel and the sealing member abut or lock together to form an airtight and/or liquid tight seal therebetween; however, this is not required. Interfaces other than flat interfaces distribute the sealing forces over a greater surface area and therefore improve the beneficial sealing properties of the container. This interface (i.e., non-flat sealing interfaces) also generates oblique mechanical forces which further enhance the beneficial sealing properties of the subject apparatus.

In another and/or alternative non-limiting aspect of the invention, the container lid can include an optionally substantially planar center window; however, this is not required. As can be appreciated, the center window can include ridges or bevels as a means for stacking other lids or container bases; however, this is not required. In one non-limiting embodiment, the cover window portion may include the name of the product and/or other types of information; however, this is not required. Furthermore, the cover window portion can be substantially transparent so as to allow the user to see the content stored in the container, especially food products; however, one or more portions or the complete cover window portion can be opaque, semi-opaque, non-opaque, and/or translucent.

In another and/or alternative non-limiting aspect of the invention, the center window can optionally include a sealing flange extending continuously and perpendicularly in a downward direction relative to the bottom surface of the center window; however, this is not required. The sealing flange of the cover window portion can optionally be disposed at or near the peripheral edge of the cover window portion; however, this is not required. The sealing flange can form an interior and exterior flange surface; however, this is not required. As such, the exterior flange surface can form a seal with the interior surface of the container body sidewall; however, this is not required. In one non-limiting embodiment, the sealing flange can be configured to accommodate the shape of the opening created by the container body; however, this is not required. In another non-limiting configuration, the sealing flange can be configured such that the exterior surface of the sealing flange frictionally engages with the interior sidewall surface of the container body sidewall; however, this is not required. In another and/or alternative non-limiting configuration, the height of the sealing flange can be substantially constant around at least part of the perimeter of the container body for the purpose of maintaining a consistent seal (i.e., about the complete perimeter of the center window); however, this is not required. In yet another and/or alternative non-limiting embodiment, the exterior surface of the sealing flange can be provided with one or more surface projections disposed thereon; however, this is not required. The one or more surface projections (when used) can be configured to increase the frictional engagement between the sealing flange and the container body sidewall; however, this is not required. The one or more surface projections can be provided on one or more sides of the exterior surface of the sealing flange; however, this is not required. In one non-limiting arrangement, the center window is plastic; however, this is not required. As can be appreciated, other and/or additional materials can be used (e.g., glass, wood, composite materials, etc.).

In another and/or alternative non-limiting aspect of the invention, the outer rim portion of the container lid can form an interior and exterior surface. As such, the interior surface can form a seal with the exterior surface of the container body sidewall; however, this is not required. In one non-limiting configuration, the outer rim portion can be designed to accommodate the shape of the opening created by the container body; however, this is not required. In one non-limiting configuration, the outer rim portion is designed and configured such that the interior surface of the outer rim portion frictionally engages with the exterior surface of the descending sidewall portion of the container body sidewall; however, this is not required. In another and/or alternative non-limiting configuration, the height of the outer rim portion is substantially constant around at least part of the perimeter of the container lid for the purpose of maintaining a consistent seat; however, this is not required. The outer rim portion can be substantially parallel to the sealing flange of the center window and extend along all sides of the container lid; however, this is not required. Generally, the parallel outer rim portion and sealing flange can frictionally engage with the container body sidewall, thereby facilitating in maintaining the container lid and container body together when in a closed position; however, this is not required. The outer rim portion can be provided with one or more surface projections provided thereon for the purpose of facilitating in maintaining the container lid on the container body when in an at least partially closed position; however, this is not required. The one or more surface projections (when used) can be provided on one or more sides of the interior surface of the outer rim portion of the container lid and be configured to enhance the frictional engagement between the outer rim portion and descending sidewall portion of the container body; however, this is not required. In one specific embodiment, the one or more surface projections are provided along all sides of the outer rim portion; however, this is not required. The size and/or shape of the one or more surface projections are non-limiting. In one specific embodiment, the outer rim portion of the container lid is plastic; however, this is not required. As can be appreciated, other and/or additional materials can be used (e.g., glass, wood, composite materials, etc.).

In another and/or alternative non-limiting aspect of the invention, the container lid can optionally include a sealing member. As can be appreciated, the container body can also or alternatively include a sealing member; however, this is not required. The outer rim portion and center window of the container lid can be connected by the sealing member disposed therebetween; however, this is not required. As such, the center window of the container lid system can configured in a floating window configuration (i.e., the center window is formed separately from the other components of the container lid); however, this is not required. The sealing member may be an extruded or molded elastomeric member; however, this is not required. In one non-limiting configuration, the sealing member is an injection-molded unitary part. The sealing member may be made of a silicon or thermoplastic elastomer (TPE); however, other materials can be used. In a closed position, the sealing member can be brought into compression with the channeled rim portion of the top peripheral surface of the container body; however, this is not required. The sealing member can be sized to have a length equivalent to the length of the top peripheral surface; however, this is not required. The thickness the sealing member is non-limiting. The connection between the outer rim portion, sealing member, and cover window portion can be facilitated by many techniques known in the art. In one non-limiting example, the outer rim portion and cover window portions can be formed in a first step (e.g., injection molded, etc.). In a second step, the sealing member can be attached onto and/or between the outer rim portion and cover window portion such that the sealing member can be attached to both the outer rim portion and the cover window portion. In another and/or alternative non-limiting example, the outer rim portion, cover window portion and sealing member can be formed and attached in the same step; however, this is not required. In yet another and/or alternative non-limiting example, the attachment between the outer rim portion, sealing member and the cover window portion can include intermolecular bonding via heat (e.g., melted bond); however, other or additional arrangements can be used (e.g., adhesive, friction connection, mechanical locking connection, etc.). As such, the materials of the outer rim portion and cover window portion can be intermixed with the material of the seal member thereby creating a melted bond of increased strength so as to prevent the sealing member from separating from the other components of the container lid. The integrally formed sealing member in the container lid facilitates in creating an airtight and/or liquidtight seal between the container lid and the container body when the container is in the closed position. In addition, the integrally attached sealing member, when used in conjunction with a container body channel, can generate additional forces and maintain a steady compression state of the elastomeric seal member around the container body; however, this is not required. As such, the airtight and/or liquid tight seal can be enhanced. In one specific embodiment, the sealing member can be made to extend downward from the top surface of the container lid at least partially between the outer rim portion and sealing flange. In one non-limiting aspect of the present invention, the sealing member can at least partially form: 1) the engagement between the interior surface of the outer rim portion and the exterior surface of the descending sidewall of the container body; 2) the engagement between the one or more surface projections of the interior surface of the outer rim portion and the exterior surface of the descending sidewall of the container body; 3) the engagement between the sealing member and the channeled top peripheral surface of the container body; 4) the engagement between the exterior surface of the sealing flange and the interior surface of the container body sidewall; and/or, 5) the engagement between the one or more surface projections on the exterior surface of the sealing flange and the interior surface of the container sidewall.

In another and/or alternative non-limiting aspect of the invention, one or more latching and/or locking features can be provided on the container for the purpose of securing the container lid to the container body and thereby creating and/or providing an airtight and/or liquidtight (e.g., liquid proof seal) seal between the container body and container lid. In one non-limiting embodiment of the present invention, the container has a plurality of different latch arrangement; however, this is not required. Alternatively, the container can have a single type of locking arrangement. According to one non-limiting aspect of the present invention, the one or more latching and/or locking features of the container include one or more latch hooks and/or fastening ribs and one or more corresponding latch flanges and/or fastening pieces. As such, the one or more latch hooks and the one or more corresponding latch flanges are provided for the purpose of securing the container lid in the closed and sealed position on the container body. The present invention overcomes past problems of prior art containers wherein the latches or clasps are only provided on the front edge of the lid (i.e., the side opposite a hinge) and the lid may bow axially away from the lateral sides extending between the front and rear sides such that the container lid does not seat well on the top surface of those lateral sides. The container of the present invention is designed and configured to improve the seal and seat between the container lid and the container body such that an airtight and/or liquidtight seal is created when the container lid is in the fully closed and fully locked position on the container body.

In another and/or alternative non-limiting aspect of the invention, the fastening flanges can be integrally formed with the outer rim portion of the container lid by injection molding; however, this is not required. Each of the fastening flanges can be formed at the upper edge thereof and can be attached at a pivot point or pivot groove such that the fastening flange can be rotated at a lower edge of the outer rim portion of the container lid; however, this is not required. In other and/or alternative non-limiting embodiments, the fastening flanges can be formed at the lower edge of the outer rim portion of the container lid; however, this is not required. The one or more fastening flanges can include one or more slits and/or openings provided thereon; however, this is not required. As such, the fastening flanges can include a slit cut approximately in a lengthwise direction (i.e., parallel to the pivot point), and be integrally formed at a central portion thereof; however, this is not required. The one or more slits and/or openings in the one or more fastening flanges can be designed and/or configured to accommodate the one or more latch hooks disposed on the container body; however, this is not required. The one or more fastening flanges can optionally include a hook feature extending the length of the fastening flange for the purpose of hooking to the container body (e.g., hooking the sealing lip provided by the U-shaped open edge of the container body, etc.); however, this is not required. As such, the fastening flanges can be configured to hook onto and securably and releasably attach to the container body (e.g., the sealing lip of the container body, etc.); however, this is not required. One or more of the fastening flanges can be approximately trapezoidal; however, other and/or alternative shapes can be used (e.g., rectangular, square, oval, T-shaped, etc.). The shape of the fastening pieces can be selected for increased rigidity when locking and unlocking the container; however, this is not required. The fastening flanges can be integrally formed with the outer rim portion of the container lid by injection molding and include a fastening hook; however, this is not required. As can be appreciated, one or more of the fastening flanges can be separate pieces that can be connectable to the container lid; however, this is not required. One or more fastening hooks can be integrally formed on the container body (e.g., formed on with the descending sidewall portion of the container body, etc.). The fastening hooks can be configured to corresponding shape and/or size to the one or more fastening flanges on the container lid; however, this is not required. As such, the fastening hooks can include one or more protrusions (e.g., protrusion in the lateral direction, etc.) at positions respectively corresponding with the one or more fastening members (e.g., slits and/or openings, etc.) of the fastening flange. In one non-limiting arrangement, one or more of the fastening hooks can protrude from the sidewall and/or the continuous extensions of the descending sidewall portions of the container body; however, this is not required. In one non-limiting configuration, the continuous extension of the descending sidewall portion can be approximately trapezoidal; however, this is not required. As can be appreciated, other and/or alternative shapes can be used (e.g., rectangular, square, triangular, T-shaped, etc.). In use, the one or more fastening flanges can be pushed onto the fastening hooks, thereby locking the container lid to the container body. As such, the one or more fastening flanges can be configured to be releasably secured to the fastening hook. As the container lid is locked onto the container body (i.e., the fastening flange is secured to the fastening hook), an airtight and/or liquid tight seal can be formed between the container lid and the container body. In another and/or alternative non-limiting aspect of the invention, the descending sidewall portion of the container body (when used) may itself serve the purpose of the sealing lip and/or fastening point to which the one or more hook features of the one or more fastening flanges on the container rim portion can connect; however, this is not required.

In another and/or alternative non-limiting aspect of the invention, the container can include a second type of latch provided on the opposite side of the container as the hinge (e.g., living hinge, etc.); however, this is not required. The second type of latch (when used) can be a thumb latch; however, this is not required. A latch flange can be integrally formed with the outer rim portion of the container lid by injection molding and optionally attached to an upper edge thereof; however, this is not required. The latch flange can be attached to a pivot point or pivot groove such that the flange can be rotated around the pivot point or pivot groove to lock the container lid onto the container body; however, this is not required. The latch flange can include a hook provided on one or both sides of the latch flange for the purpose of coupling with a latch hook provided on the sidewall of the container body; however, this is not required. In use, the container lid is closed and compressed on the container body so that the latch flange can couple with the latch hook thereby locking the container lid to the container body. Other non-limiting embodiments can use latches at different locations such as at the corners rather than the middle portion of container lid and/or the container body can include the latch arrangement; however, this is not required. One exemplary embodiment of the invention employs three latches in the middle of each of the three sides of the container lid periphery of a container lid that has four sides; it can be appreciated that other non-limiting embodiments may employ a fewer or a greater number of latches for similar shaped container lids or for different shaped container lids. Similarly, another exemplary embodiment of the invention employs two different types of latches; however, it can be appreciated that other non-limiting embodiments may employ a single type of latch or more than two different types of latches.

In another and/or alternative non-limiting aspect of the invention, the container lid and/o the container body can be partially or fully formed by injection molding with transparent or translucent synthetic resin; however, this is not required. In one non-limiting specific embodiment, about 50-100% of the container body and the container lid are made of plastic. In a specific configuration, the container body is formed of a polycarbonate material and at least a portion of the container lid is formed of polypropylene. However, it can be appreciated that the container body and/or container lid can be formed of other or additional materials (e.g., a high-density polyethylene (HDPE) plastic, a low-density polyethylene (LDPE) plastic, a rubber material, polyvinyl chloride (PVC), various types of resins, various types of resin epoxides, polyester, polypropylene, polyurethane, polyacrylate, polycarbonate and copolymers thereof, etc.). When the container body is formed of a polycarbonate material, the type of polycarbonate used is generally a non-staining or stain resistant polycarbonate material. Such a material is useful in that it will resist discoloration from food when the foods are stored, heated and/or cooked in the container body; however, this is not required. Generally, the container body is formed of a different material than the one or more materials used to form the container lid; however, this is not required. Generally, the container body is formed of a harder and less flexible material than at least one or all of the materials used to form the container lid. In such a non-limiting arrangement, the container body is a substantially rigid component and the lid is a generally flexible component of the container.

The thickness of the material used to form the container body and the container lid is non-limiting. In one non-limiting embodiments, the thickness of the material used to form at least the container body and/or one or more portions of the container lid is about 0.2 mm to about 4 mm, particularly about 0.5 mm to about 1.5 mm, and more particularly about 0.8-1.2 mm (e.g., 1 mm). However, other dimensions may be used.

In another and/or alternative non-limiting aspect of the invention, one or more additives can be added to the material used to form the container; however, this is not required. As such, the additives can be added for the purpose of making the container stain- and/or odor-resistant, dishwasher safe, microwave safe, refrigerator safe, freezer safe, add color, scent, etc. In yet another and/or alternative non-limiting aspect of the invention, the material used to form the container can be Bisphenol A (BPA) free; however, this is not required. In still yet another and/or alternative non-limiting aspect of the invention, the container can be formed from recycled materials (e.g., plastics, etc.); however, this is not required.

In another and/or alternative non-limiting aspect of the invention, the container body has a generally square cross-sectional shape; however, the container body can have other cross-sectional shapes (e.g., rectangular, circular, etc.). The volume of the cavity of the container body that is used to receive food or other materials generally has a volume of about two ounces to two gallons; however, other volumes can be used (e.g., 0.5 cup, one cup, two cups, four cups, 0.25 liter, 0.5 liter, one liter, two liters, eight cups, twelve cups, one gallon, five gallons, etc.).

In another and/or alternative non-limiting aspect of the invention, the container lid and container body can include stacking channels and/or bevels provided for the purpose of promoting the stackability of the container lids and/or the container body during the shipping of multiple container lids and/or container bodies; however, this is not required.

In one non-limiting embodiment of the present invention, the lockable container includes a container body that is configured to hold food and/or other items and a container lid that includes a hinge (e.g., living hinge) that permanently and/or securely connects the container lid to the container body. The top of the container body includes a sealing lip that is configured to engage a sealing element on the container lid when the container lid is moved to the closed position. The container lid includes one or more securing latches configured to be releasably secured to latch connectors on the container body so that the container lid, when positioned in the closed position, can be locked in the fully closed and locked position when the securing latches are releasably secured to the latch connectors. The container lid can include a sealing that is configured to form a liquid tight and/or airtight seal with the sealing lip of the container body when the container lid is in the fully closed and locked position on the container body. When the container lid includes two or more securing latches, the securing latches can be configured to be the same or a different shape and can be configured to be used with the same or different mechanism to releasably connect the container lid to the container body. In one non-limiting arrangement, the container lid includes two side securing latches that are configured the same and a front latch that is configured differently from the two side securing latches. The container body and container lid can have non-limiting shapes and sizes and can be configured to hold any volume of items. The materials used to form the container body and the container lid are non-limiting (e.g., metal, plastic, ceramic, glass, composite materials, etc.). The materials used to form the container body and the container lid can be clear, opaque, semi-opaque, and/or non-opaque.

In another and/or alternative non-limiting embodiment of the present invention, the lockable container can include a container body that defines a storage area and which has an open end. The open end has a peripheral top surface and a descending wall portion spaced apart from the container body sidewall. The container body further includes a plurality of spaced ribs extending between the container body sidewall and the descending wall of the top peripheral surface. The container body further includes a top peripheral surface that has a channel in the top peripheral surface. The container lid is configured to be attached to the container body to cover the open end of the storage container. The container lid includes an outer rim portion and a cover window portion separated by a sealing member. The sealing member is located between the outer rim portion and cover window portion for the purpose of creating and/or providing an airtight and/or liquidtight seal between the container body and the container lid when the container lid in the fully closed and locked position on the container body. The container lid includes a living hinge that connects the container lid to the container body. The hinge includes one or more pivot points (e.g., 2 pivot points or 2 pivot grooves, etc.). The container lid includes a plurality of latches that are configured to be rotated about a hinge (e.g., living hinge, etc.) between an open (unlatched) and closed (latched) position. The container can be configured such that the container lid and the container body provide an airtight and/or liquidtight seal when in the fully closed and locked position. When the container lid is in the fully closed and locked position on the container body, the plurality of latches on the container lid are engaged with the fastening members (e.g., fastening ribs, etc.) of the container body, and the sealing member on the container lid is compressed against the top peripheral surface of the container body thereby creating an airtight and/or liquidtight seal between the container body and the container lid.

According to one non-limiting aspect of the present invention, a method for using said lockable container in the storage of food items can comprise the steps of: placing the container on a surface such that the open end of the container faces at least partially upwards; placing a material in the cavity of the container body; moving the container lid to a closed position by rotating the lid member about the living hinge; locking the latches of the container lid to the container body such that the container lid is in the fully closed and locked position on the container body and an airtight and/or liquidtight seal is created between the container body and the container lid; and optionally placing the container in a refrigerator and/or cabinet to be stored until further use as needed or desired. One or more containers can be stacked on top of one another to conserve space when stored; however, this is not required. The above steps can be reversed to obtain access to the contents in the cavity of the container body and/or the container lid is in the fully closed and locked position on the container body prior to inserting materials into the cavity of the container body.

One non-limiting object of the present invention is to provide an at least partially airtight and/or liquidtight, lockable container that has a balance of improved properties that are useful in commercial and/or home use food storage and/or other storage applications.

Another non-limiting objective of the present invention is to provide a lockable container that can be airtight and/or liquidtight, lockable, leak-proof, microwavable, and wherein the container lid can be repeatedly and releasably secured to the container body.

These and other objects, features and advantages of the present invention will become apparent from the subsequent description taken in conjunction with the accompanying drawings.

BRIEF DESCRIPTION OF THE DRAWINGS

Reference may now be made to the drawings which illustrate various non-limiting embodiments that the invention may take in physical form and in certain parts and arrangement of parts wherein.

DETAILED DESCRIPTION OF THE NON-LIMITING EMBODIMENTS

Figure 1:
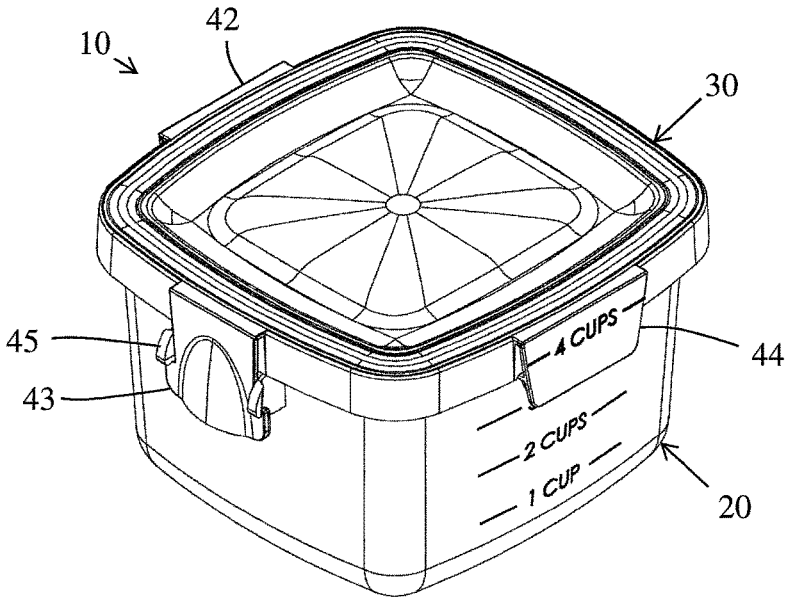
FIG. 1 is a perspective illustration of one non-limiting lockable container according to the present invention wherein the container lid is in the fully closed and locked position.

Referring now to the drawings, wherein the showings are for the purpose of illustrating non-limiting embodiments of the invention only and not for the purpose of limiting the invention, FIGS. 1-15 illustrate a lockable container 10 comprising a container body 20 and a container lid 30 that can be used in and/or in conjunction with the storage and preservation of foodstuffs and/or other materials.

As illustrated in FIGS. 1-15, the lockable container of the present invention can be designed to be used in conjunction with food storage; however, it can be appreciated that the present invention is also amenable to other applications (e.g., general storage, etc.). The lockable container includes a container body 20. The container body has a base or bottom 22, one or more sidewalls 24 that are connected to the base and extend upwardly from the top surface of the base, and a body cavity 26 that is defined by the top surface of the base and the inner surface of the one or more sidewalls. The cavity has an opening in the top which can be covered by the container lid as will be discussed in more detail below. The container body is illustrated as being generally bowl-shaped with four sidewalls; however, the container body can have other shapes and/or a different number of sidewalls. The container lid 30 includes a hinge 40 such as, but not limited to a living hinge, that couples the container lid to the container body. The hinge can be formed such that the hinge is permanently and/or securely connected to the container lid and the container body and would be required to be cut or otherwise damaged to separate the container lid from the container body. Alternatively, the hinge can be permanently formed on the container lid and be connectable to the container body such that once the hinge is connected to the container body, the hinge is not intended to ever be subsequently disconnected from the container body and the forcing of such disconnection would result in damage to the hinge and/or the container body. Alternatively, the hinge can be permanently formed on the container body and be connectable to the container lid such that, once the hinge is connected to the container lid, the hinge is not intended to ever be subsequently disconnected from the container lid and the forcing of such disconnection would result in damage to the hinge and/or the container lid. Alternatively, the hinge can be configured to be connectable to both the container lid and the container body such that once the hinge is connected to both the container lid and the container body, the hinge is not intended to ever be subsequently disconnected from the container body and the container lid and the forcing of such disconnection would result in damage to the hinge and/or the container body, and/or the hinge and/or the container lid.

The container body and the container lid include a plurality of structures that are configured to secure the container lid in the fully closed and locked position on the container body.

Referring now to FIG. 1, there is illustrated a perspective view of a non-limiting lockable container 10 in a fully closed and locked position according to the invention. The lockable container 10 can include a locking mechanism that creates an airtight and/or liquidtight seal between the container lid and container body when the container lid is on the fully closed and locked position on the container body. The container body can be partially or fully formed by injection molding with a transparent or translucent synthetic resin; however, this is not required. Likewise all or some portion of the container lid can also formed by injection molding with a transparent or translucent synthetic resin; however, this is not required. In one non-limiting configuration, at least a portion of the container lid plastic can be formed of an olefin thermoplastic (e.g., polypropylene, polyethylene, block copolymer polypropylene, etc.); however, it can be appreciated that one or more portions of the container lid can be formed of other or additional materials. In another non-limiting configuration, the container body can at least partially or fully formed of polycarbonate; however, it can be appreciated that the container body can be formed of other or additional materials. In another non-limiting configuration, the container body can at least partially or fully formed of polycarbonate, and the container lid plastic can be at least formed of an olefin thermoplastic, and the sealing member can be formed of an elastomeric material, and the container lid does not container polycarbonate.

Figure 2:
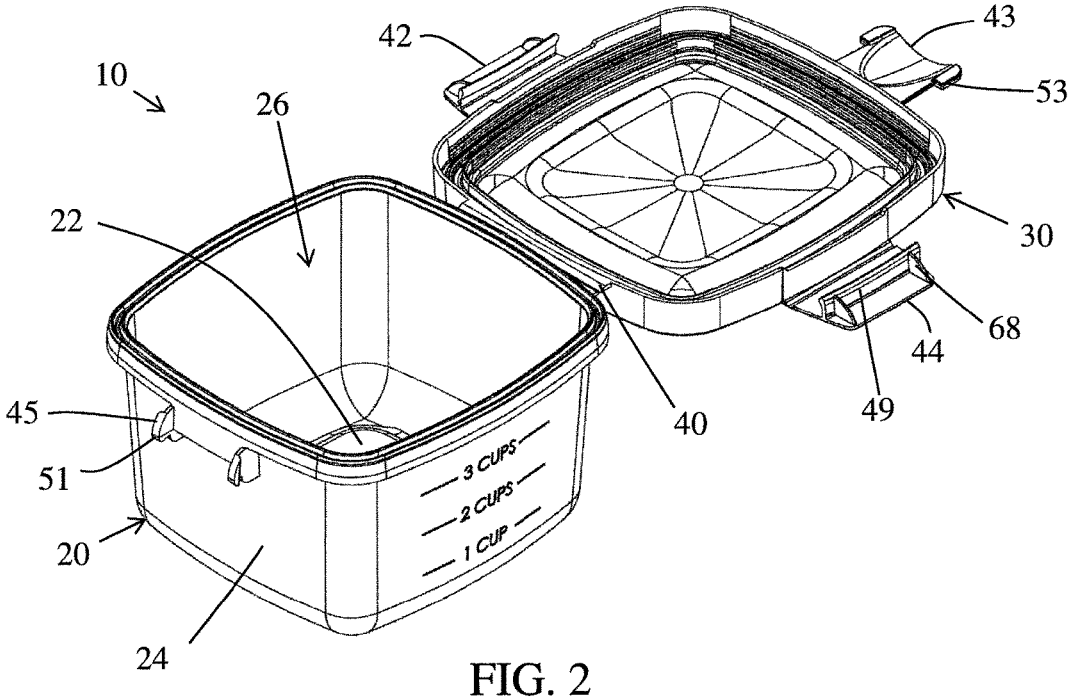
FIG. 2 is a perspective illustration of the lockable container of FIG. 1 wherein the container lid is on the open position.

Referring now to FIG. 2, the lockable container 10 is in an open/unlatched position. The container lid is still connected to the container body in such position; however, the body cavity 26 is not accessible so that materials (e.g., food items, etc.) can be easily inserted into or removed from the body cavity. The container lid includes a plurality of lid latches 42, 43, and 44. The latches are moveable between an open and locked position. FIG. 1 illustrates the latches in the locked or latched position. FIG. 2 illustrates the latches in the open or unlatched position. The latches can be connected by a living hinge to the rim or some other portion of the container lid; however, this is not required. Generally, the latches are permanently connected to the rim or some other portion of the container lid; however, this is not required. As illustrated in FIG. 1, the latches, when in the locked position, releasably connect to arrangement on the container body which will be discussed in more detail below.

Figure 3:
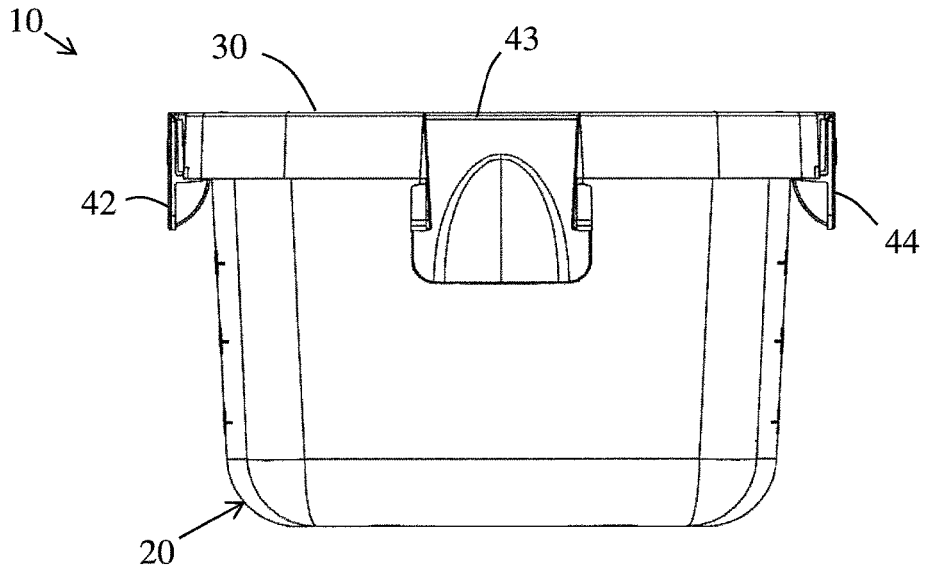
FIG. 3 is a front plan view of the lockable container of FIG. 1.
Figure 4:
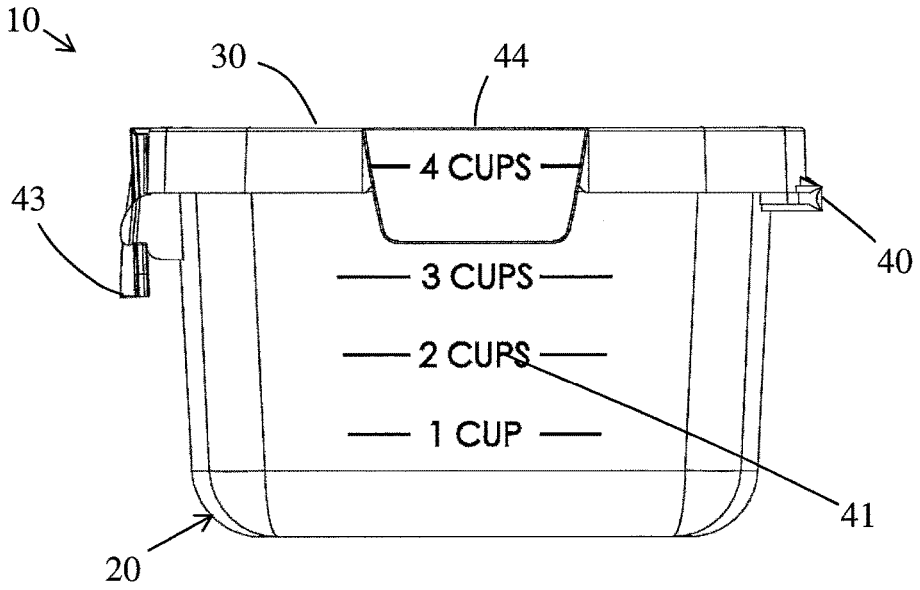
FIG. 4 is a side plan view of the lockable container of FIG. 1.

FIG. 3 and FIG. 4 are front and back perspective view illustrations, respectively, of the container body. One or more sidewalls 24 can include markings 41 as illustrated in FIG. 4. The type of markings is non-limiting. As illustrated in FIG. 1, the markings are cup measurement markings that provide information about how much of a liquid material is contained in the body cavity 26 of the container body. As can be appreciated, metric measurement markings can be located on the same or different sidewall of the container body. As can be appreciated, other or additional types of markings can be included on the container body and/or container lid (e.g., "Do not fill above this line", "Microwaveable", brand name, etc.).

Figure 5:
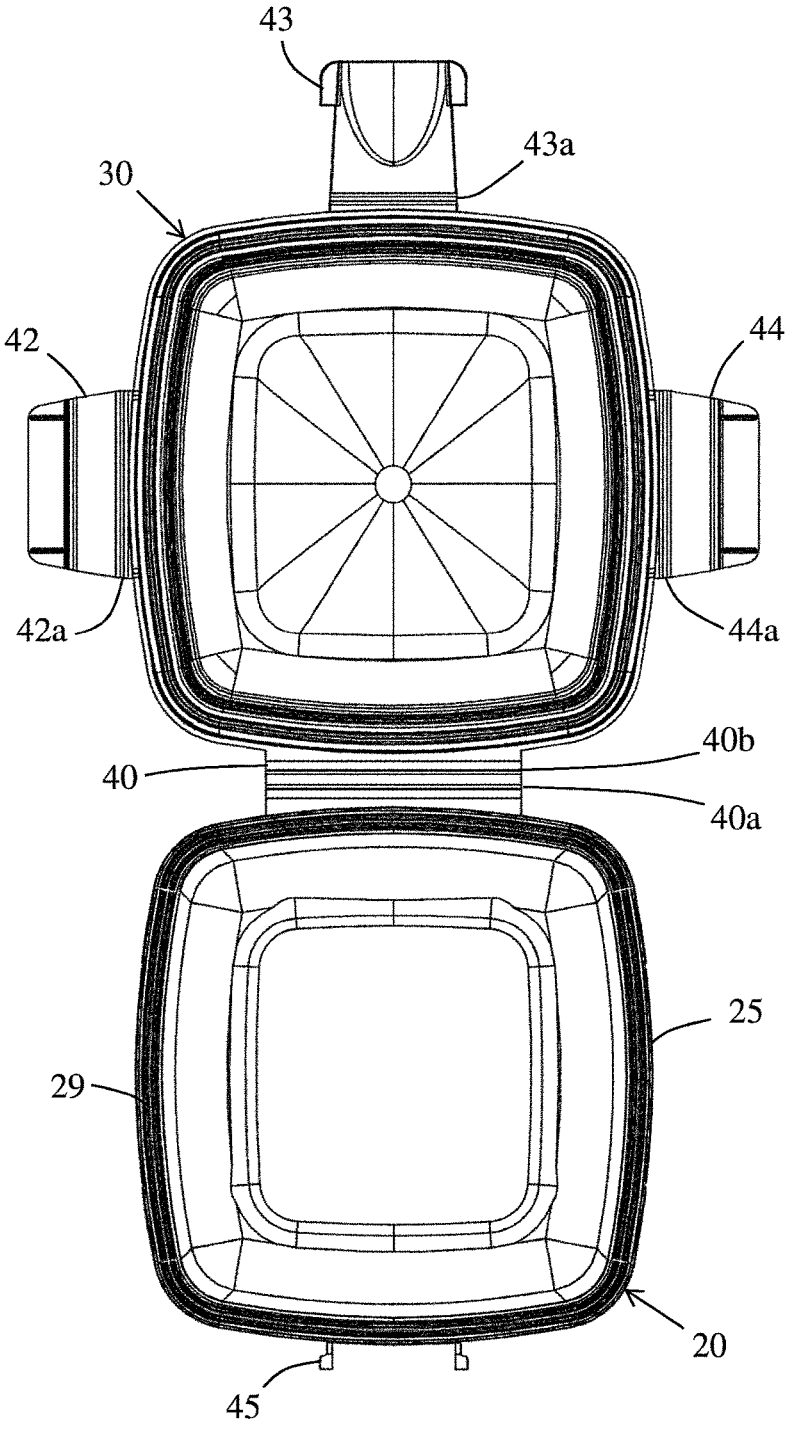
FIG. 5 is a top plan view of the lockable container of FIG. 2.
Figure 6:
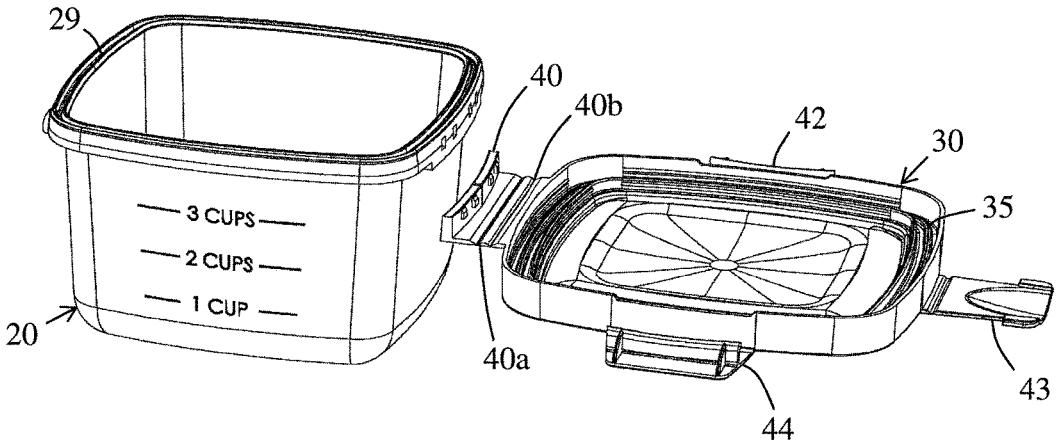
FIG. 6 is a perspective illustration of the lockable container of FIG. 2 wherein the container lid is detached from the container body.
Figure 7:
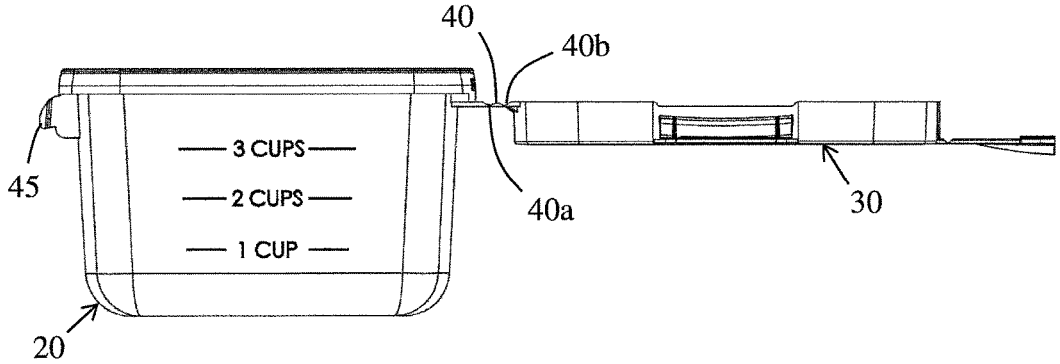
FIG. 7 is a perspective illustration of the lockable container of FIG. 2 wherein the container lid is connected to the container body.

As best illustrated in FIGS. 5-7, a living hinge 40 connects the container lid 30 to the container body 20. The living hinge 40 allows the container lid system 30 to pivot relative to the container body 20 between the open and closed position. The living hinge can include one or more pivot points. As illustrated in FIG. 5, the living hinge includes two pivot points 40*a*, 40*b* that are spaced on sidewall 24 of the container body and outer rim portion 32 of container lid 30. As can be appreciated, a pivot point can optionally exist at the connection point of hinge 40 outer rim portion 32 of container lid 30 and/or the connection point of hinge 40 the container body. The pivot point can be in the form of a groove, a thin later, flexible material, etc. that enables movement so that the hinge can allow the container lid to move between the fully open position (as illustrated in FIG. 2) and the fully closed and locked position (as illustrated in FIG. 1). The configuration of hinge 40, in combination with the configuration of the container lid and the container body, enables the container lid to lie substantially flat over the perimeter of the cavity opening of the container body, thereby inhibiting or preventing the container lid from bowing upwards when the container lid is moved to the closed position and then ultimately moved to the fully closed and lock position. The use of one or more pivot points in the hinge allows the container lid to be closed flat onto the container body thus improving the seal between the container lid system and the container body. As such, the hinge can be used to improve the sealing between the container lid and the container body.

Referring now to FIGS. 6 and 7, during manufacturing, the container lid 30 can be manufactured or assembled as one separate component and the container body can be manufactured or assembled as a second separate component. These two separate components can subsequently be connected together via hinge 40 as illustrated in FIG. 7 during the first use of the container. The attachment of the hinge to the container body can be permanent and/or secure; however, this is not required. The permanent and/or secure attachment of the container lid to the container body prevents the recurring problem of losing the container lid as often occurs with lids that are not permanently connected to the container body. As can be appreciated, the container body and container lid can be manufactured as a single component that requires no further assembly.

Figure 8:
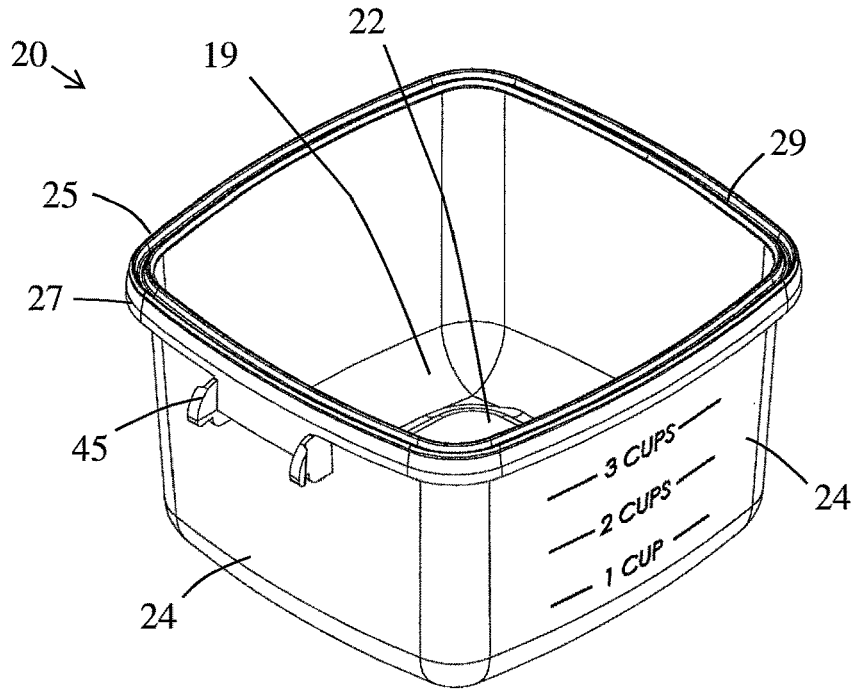
FIG. 8 is a perspective illustration of the container body of the lockable container of FIG. 1 without the container lid.

Referring now to FIGS. 5 and 8, container body 20 is illustrated as having a bowl shape and includes four sidewalls 24, which extend upwardly from the base or bottom wall 22. In one non-limiting arrangement, the sidewalls can be configured to bow outward such that the open end of the container body is larger than the base of the container body as illustrates in FIG. 5; however, this is not required. The sidewalls are connected continuously to the base or via corners 19. The corners (when used) can be rounded; however, this is not required.

As illustrated in FIG. 8, the container body 20 includes a top flange 25 that is connected at or near the top edge of the sidewalls. The top flange is illustrated as extending about the complete perimeter of the top edge of the sidewalls. The top flange is illustrated as extending outwardly from the outer surface of the side at an angle that is perpendicular or generally perpendicular (e.g., 85°-95°) to the top portion of the sidewall; however, this is not required. The top surface of the top flange forms a top peripheral surface. The top peripheral surface is illustrated as including a groove/channel 29; however, this is not required. As can be appreciated, the top peripheral surface can alternatively be flat or include one or more ribs or other structures extending upwardly from the top peripheral surface. In one non-limiting arrangement, channel 29 generally has a V-shape or U-shape and is configured to at least partially receive a sealing member 34 on the container lid when the container lid is moved to the closed position. When the container lid is in the fully closed and locked position, the sealing member in channel 29 can partially or fully form the airtight and/or liquidtight seal between the container lid and the container body. As can be appreciated, the airtight and/or liquidtight seal between the container lid and the container body can be partially or fully formed by the sealing member with a top peripheral surface that is absent a channel and/or includes other structures.

Figure 9:
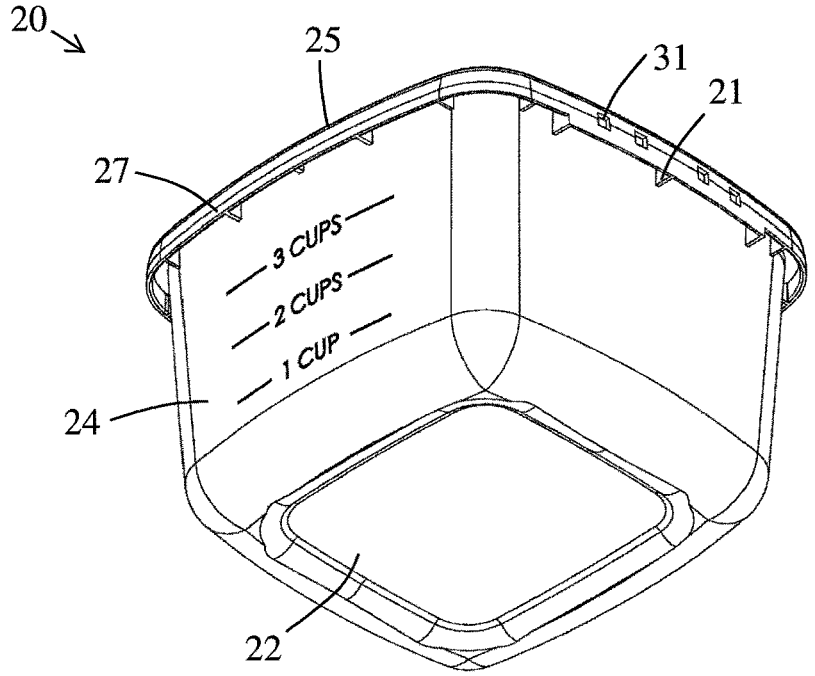
FIG. 9 is a section view of the container body of the lockable container of FIG. 2 without the container lid.
Figure 10:
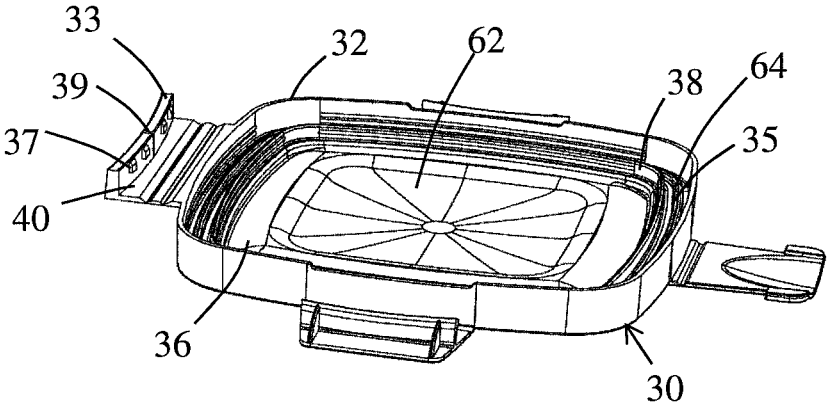
FIG. 10 is a perspective illustration of the bottom side of the container lid of FIG. 2 without the container body.

As illustrated in FIG. 8, the outer edge of the top flange 25 can extend downwardly from the top peripheral surface to form a descending sidewall 27; however, this is not required. Generally, the descending sidewall 27 extends downwardly at an angle that is perpendicular or generally perpendicular to the top peripheral surface. As illustrated in FIG. 9, the descending sidewall 27 includes one or more connection openings 31 that are configured to receive connection tabs 37 on the end of hinge 40 as illustrated in FIG. 10. The end of the hinge can include an end flange 33 that can include the one or more connection tabs 37; however, this is not required. The connection tabs are typically configured to be at least partially inserted into connection openings 31 and, once connected, are not designed to be disconnected from the connection openings. However, it can be appreciated that the connection tabs can be configured to be releasably connected to the connection openings. The shape and size of the connection tabs and connection openings are non-limiting. As illustrated in FIG. 9, the descending sidewall 27 is spaced from the outer surface of sidewall 24 so that the end flange 33 of the hinge can be inserted in the space between the outer surface of the sidewall and the inner surface of the descending sidewall 27 so that the connection tabs and connection openings can be aligned with one another and thereafter connected together.

As illustrated in FIG. 9, one or more spaced ribs 21 can be optionally provided between the descending wall portion 27 and the sidewall of the container body. The one or more ribs can be used to provide strength to the top flange 25 and the descending wall portion 27. The one or more ribs (when used) include generally flat bottom edges. One non-limiting advantage of using such ribs is that, when securing latch hooks of the container lid system are pulled off of the container body (i.e., unlatching and/or opening the container), the securing lip of the container body is not malformed, altered, or distorted. Thus, the longevity and durability of the container is increased.

As illustrated in FIG. 10, the end flange 33 can include a guide slot 39 that is configured to receive a rib 21 when the end flange 33 is inserted in the space between the outer surface of the sidewall and the inner surface of the descending sidewall 27. As such the guide slot is used to facilitate in properly positioning the end flange 33 relative to the descending sidewall 27 when connecting the hinge to the container body.

As illustrated in FIG. 9, the bottom surface of the base wall 22 can include ridges and/or bevels; however, this is not required. The ridges and/or bevels can be used as a means of stacking other bases together; however, this is not required.

As illustrated in FIGS. 1, 2 and 8, the container body includes a latch connector 45. As illustrated, the latch connector 45 is positioned on the front sidewall of the container body and is configured to connect to front thumb latch 43 on the container lid. When the container lid is in the closed position, the container lid can be locked to the container body by securing the front thumb latch 43 to the latch connector 45. Latch connector 45 can be a continuous extension of the descending sidewall 27. Additionally or alternatively, latch connector 45 can be connected to the outer surface of sidewall 24. The latch connector can include at its distal end a hook-like portion 51 capable of inhibiting or preventing the front thumb latch 43 from becoming unlatched from the latch connector 45 without excessive force. The front thumb latch 43 can include one or more tabs 53 that are configured to engage the hook-like portion 51 when the front thumb latch 43 is releasably connected to latch connector 45.

Figure 15:
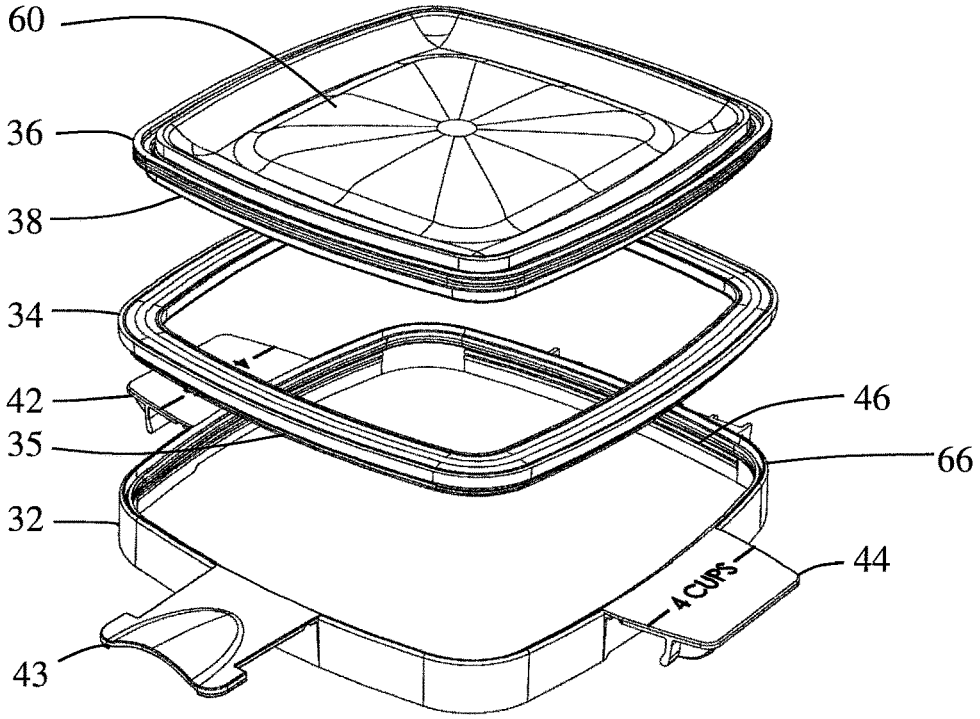
FIG. 15 is an exploded view of the container lid of FIG. 2.

Referring now to FIGS. 2, 10 and 15, the container lid 30 is formed of three components, namely an outer rim portion 32, a sealing member 34, and a center window 36. The sealing member is positioned between the center window and the outer rim portion.

As illustrated in FIGS. 10 and 15, the center window includes a top surface 60, a bottom surface 62 and a center window flange 38. The center window flange 38 extends downwardly from the bottom surface 62. Generally, the center window flange 38 extends downwardly from the bottom surface 62 at an angle that is perpendicular or generally perpendicular to the plane of the bottom surface; however, this is not required. The center window flange 38 is generally positioned at or near the peripheral edge of the center window and generally extends about the complete periphery of the center window; however, this is not required. The center window flange can be configured to be inserted into the container cavity 26 when the container lid is in the closed position. The exterior surface of center window flange 38 (i.e., the surface of the center window flange that is facing the inner surface of the container body sidewall when the container lid is in the closed position) can be optionally configured to frictionally engage with at least a portion of the interior surface of a container body sidewall thereby improving the seal between the container lid 30 and the container body 20 and/or to facilitate in positioning the container lid relative to the container body when closing the container lid on the container body.

The peripheral surface of the center window can optionally include one or more grooves or other structures that can be used to facilitate in the connection of the sealing member to the center window. As illustrated in FIG. 15, the peripheral surface of the center window includes a plurality of grooves and/or ribs; however, this is not required.

The center window can optionally include a printed design, ribs that form a design etc. As illustrated in FIG. 15, the center window includes a plurality of ribs that radiate from a central circular rib. As can be appreciated, other designs can be used. The ribs can also be configured to improve the structural integrity and/or rigidity of the center window; however, this is not required. The top and/or bottom surface of the center window can optionally include other or additional structures for purposes of aesthetics, rigidity, strength etc.

The center window can optionally include one or more ridges or bevels as a means of stacking other container lids together; however, this is not required. The center window can be formed from substantially transparent materials so as to allow the user to see the contents stored within the container; however, this is not required.

Figure 11:
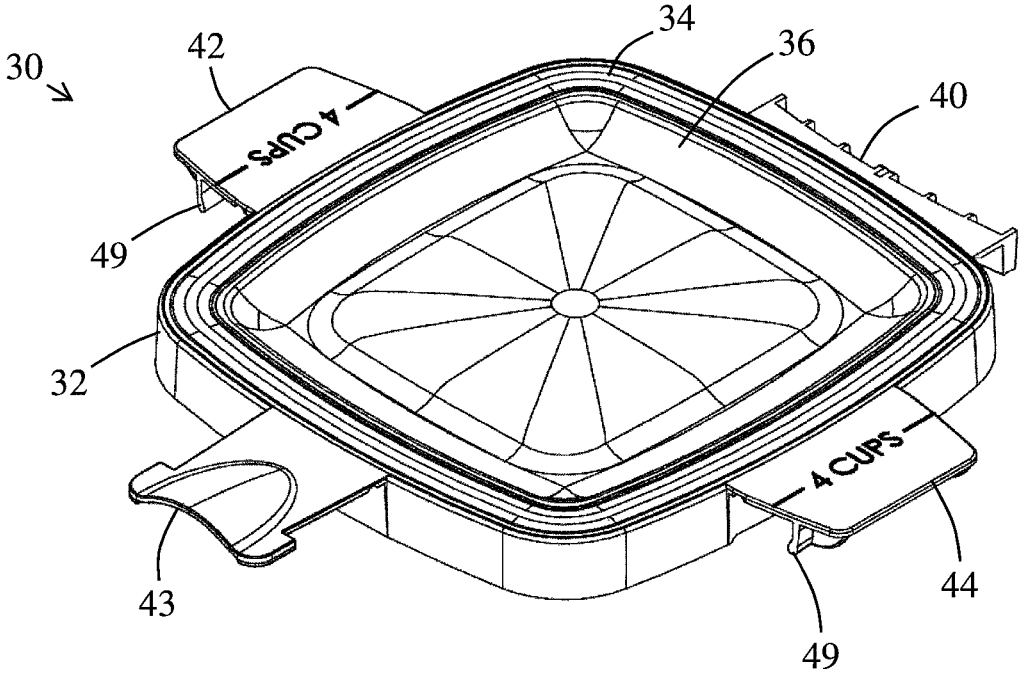
FIG. 11 is a perspective illustration of the top side of the container lid of FIG. 2 without the container body.

Sealing member 34 is configured to connect to the outer periphery of the center window. The type of connection is non-limiting (e.g., melted connection, molded connection, adhesive connection, friction connection, etc.). Generally, the inner surface of the sealing member is connected to the outer periphery of the center window; however, it can be appreciated that other or additional surfaces of the sealing member can be connected to the center window. A portion of the sealing member can be configured to extend over a portion of the top and/or bottom surface of the center window; however, this is not required. As illustrated in FIG. 11, a portion of the sealing member extends over a portion of the top of the center window. The bottom surface 35 of the sealing member can include one or more sealing structures (e.g., glove, rib, slot, etc.) that are configured to engage with the container body to create and/or facilitate in creating an airtight and/or liquidtight seal between the container lid and the container body when the container lid is in the fully closed and locked position. As illustrated in FIG. 10, the bottom surface of the sealing member includes a rib or downwardly protruding extension 64 that is configured to at least partially fit into channel 29 of the top flange 25 of container body 20 when the container lid is in the fully closed and locked position. The rib or downwardly protruding extension can have a corresponding shape as channel 29; however, this is not required. The rib or downwardly protruding extension 64 can be configured to compress in channel 29 so as to improve the seal formed between the rib or downwardly protruding extension 64 and channel 29 when the container lid is moved to the fully closed and locked position on the container body. The rib or downwardly protruding extension 64 is generally positioned about the complete periphery of the sealing member; however, this is not required. The rib or downwardly protruding extension 64 is illustrated as being spaced from the outer edge and the inner edge of the sealing member; however, this is not required. As can be appreciated, the sealing member can include more than one downwardly protruding extension 64. The height of the downwardly protruding extension 64 is generally greater than the depth of channel 29; however, this is not required. The bottom surface 35 of the sealing member can also be configured to contact the top flange 25 of container body 20 on one or both sides of channel 29 when the container lid is moved to the fully closed and locked position on the container body; however, this is not required. Such contact arrangement (when used) facilitates in the sealing between the container lid and container body when the container lid is moved to the fully closed and locked position on the container body. The bottom surface 35 of the sealing member can be configured to compress when contacting the top flange 25 of container body 20 on one or both sides of channel 29 when the container lid is moved to the fully closed and locked position on the container body; however, this is not required.

The sealing member can be an extruded or molded elastomeric material (e.g., Natural polyisoprene: cis-1,4-polyisoprene natural rubber (NR) and trans-1,4-polyisoprene gutta-percha; synthetic polyisoprene (IR for isoprene rubber); polybutadiene (BR for butadiene rubber); chloroprene rubber (CR), polychloroprene, neoprene, baypren, butyl rubber (copolymer of isobutylene and isoprene, DR), halogenated butyl rubbers (chloro butyl rubber: CIIR; bromo butyl rubber: BIER), styrene-butadiene rubber (copolymer of styrene and butadiene, SBR), nitrile rubber (copolymer of butadiene and acrylonitrile, NBR), hydrogenated nitrile rubbers (HNBR), therban, zetpol, EPM (ethylene propylene rubber, a copolymer of ethylene and propylene), EPDM rubber (ethylene propylene diene rubber, a terpolymer of ethylene, propylene and a diene-component), epichlorohydrin rubber (ECO), polyacrylic rubber (ACM, ABR), silicone rubber (SI, Q, VMQ), fluorosilicone Rubber (FVMQ), fluoroelastomers (FKM, and FEPM), viton, tecnoflon, fluorel, aflas, dai-El, perfluoroelastomers (FFKM), tecnoflon PFR, kalrez, chemraz, perlast, polyether block amides (PEBA), chlorosulfonated polyethylene (CSM), (Hypalon), ethylene-vinyl acetate (EVA), thermoplastic elastomers (TPE), proteins resilin and elastin, polysulfide rubber, elastolefin); however, this is not required. In one non-limiting configuration, the sealing member is an injection-molded unitary part. The seal member can be made of a silicon or thermoplastic elastomer; however, it can be appreciated that other materials can be used. Generally, the material that is used to form the sealing member is different from the material of the center window and/or the outer rim portion. In one non-limiting configuration, the material that is used to form the sealing member is different from both the center window and the outer rim portion. In one non-limiting arrangement, the sealing member is formed of a material that is softer and more malleable or deformable than the center window and the outer rim portion. Generally, the center window and the outer rim portion are formed of a rigid material; however, this is not required. Generally, the center window and the outer rim portion are formed of the same material; however, this is not required. Generally the center window and the outer rim portion of the container lid and the container body are formed of the same material; however, this is not required. The color of the sealing member can optionally be different from the color of the center window and/or the outer rim portion. The transparency of the sealing member can optionally be different from the transparency of the center window and/or the outer rim portion.

Figure 14:
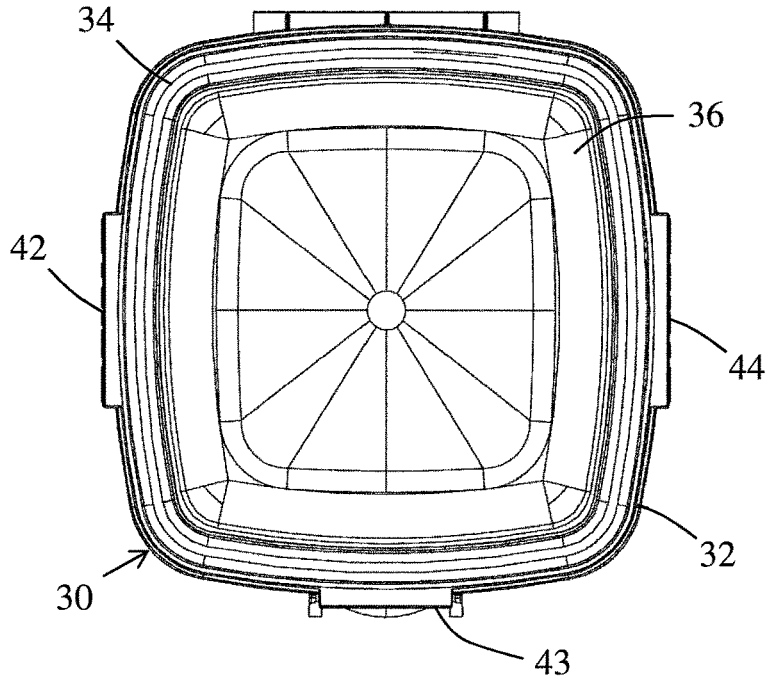
FIG. 14 is bottom plan view of the container lid of FIG. 2.

The outer rim portion 32 of container lid 30 can also serve the purpose of a sealing flange; however, this is not required. The outer rim portion is connected to the sealing member as illustrated in FIG. 14. The connection between the sealing member and the outer rim portion is non-limiting (e.g., melted connection, molded connection, adhesive connection, friction connection, etc.). Generally, the connection between the sealing member and the container lid and the outer rim portion can be a melted connection or molded connection. The sealing member, when connected to the outer rim portion, can be configured to contact at least a portion of the inner surface of the outer rim portion, at least a portion of the top surface of the outer rim portion, and/or at least a portion of the outer surface of the outer rim portion. In one non-limiting arrangement, the sealing member engages the top surface of the outer rim portion and the inner surface of the outer rim portion, but not the outer surface of the outer rim portion. In another non-limiting arrangement, the sealing member engages only the inner surface of the outer rim portion, but not the outer surface of the outer rim portion. As can be appreciated, other connection configurations can be used between the sealing member and the outer rim portion.

The outer rim portion can optionally include one or more connection channels 66 that are configured to receive a rib or downwardly protruding extension on the bottom surface of the sealing member so as to facilitate in the connection between the sealing member and the outer rim portion; however, this is not required. The connection channel 66 (when used) is positioned at or near the inner surface of the outer rim portion. As illustrated in FIG. 15, the inner surface of the outer rim portion forms one side of connection channel 66. The connection channel 66 (when used) is generally spaced form the top and/or bottom edge of the outer rim portion as illustrated in FIG. 15; however, this is not required.

The outer rim portion can be optionally configured such that the inner surface of the outer rim portion frictionally engages the outer surface of the sidewalls of the container body when the container lid is in the closed position. As illustrated in FIG. 15, the inner surface of the outer rim portion can be provided with one or more surface projections 46. The surface projections can be used to hold the container lid on the container body when the container lid is at least partially in the closed position. The surface projections 46 are generally spaced between the top and bottom edges of the outer rim portion as illustrated in FIG. 15; however, this is not required. The surface projections 46 are illustrated as being positioned below the connection channel 66.

During manufacturing of the container lid, the outer rim portion 32, center window 36, and sealing member 34 can be formed together in a one-piece construction; however, this is not required. Hinge 40 can be formed together with outer rim portion 32, center window 36, and sealing member 34; however, this is not required. In one non-limiting arrangement, the center window is formed as a single piece, the sealing member is formed a single separate piece, and the outer rim portion that includes hinge 40 and latches 42, 43, 44 is formed of a single separate piece. The sealing member is then connected to both the center window and the outer rim portion to form the container lid. The connection between the sealing member and the outer rim portion and the center member is designed to be a permanent and/or secure connection. As such, the container lid would be damaged and unable to form an airtight and/or water-tight seal if the sealing member were forced to be separated from the outer rim portion and/or center window.

Figure 12:
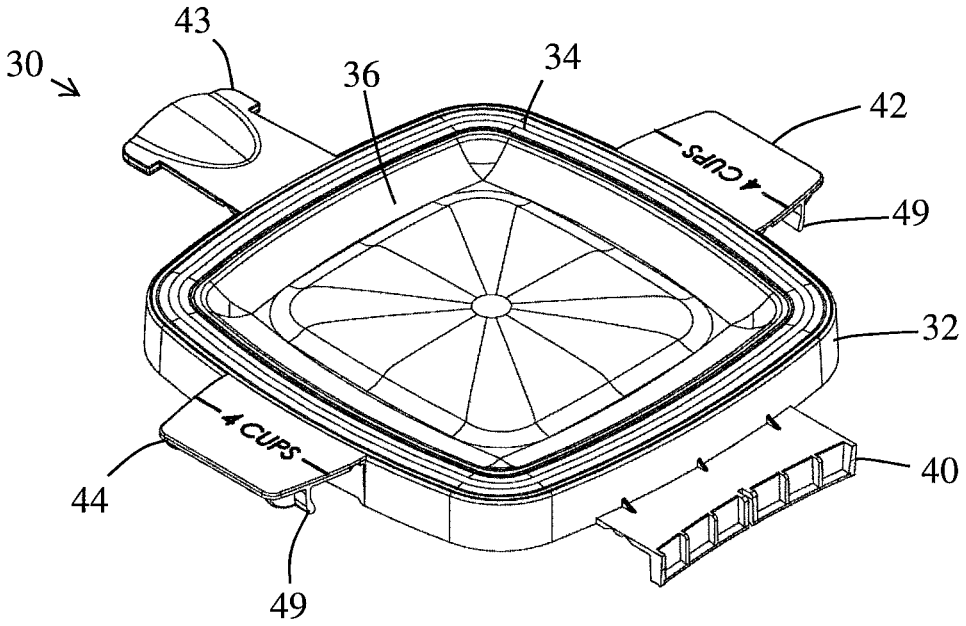
FIG. 12 is a different perspective illustration of the bottom side of the container lid of FIG. 2 without the container body.
Figure 13:
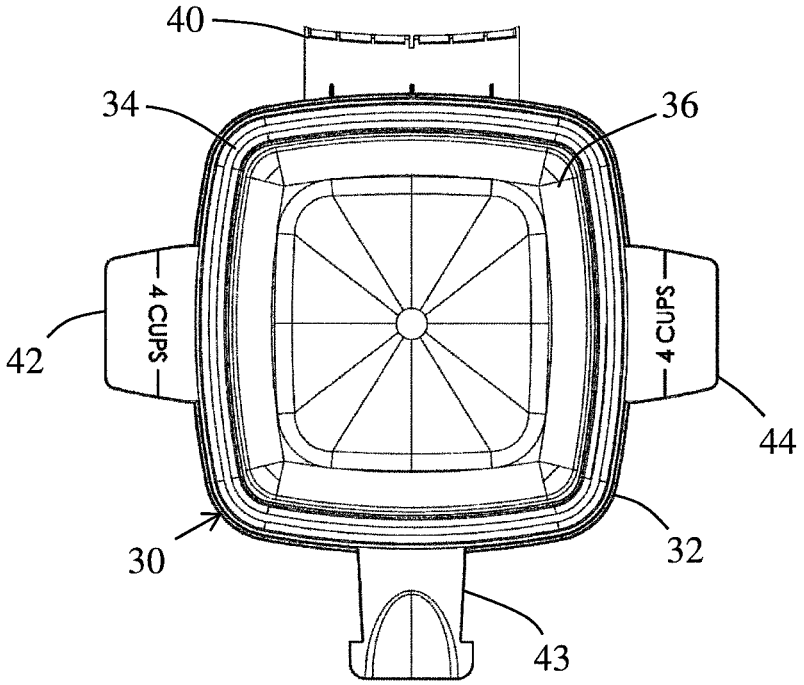
FIG. 13 is a top plan view of the container lid of FIG. 2.

Referring now to FIGS. 12-13, the container lid 30 is provided with one or more latches for the purpose of fastening the container lid 30 to the container body 20. The container lid 30 is designed and configured to improve the seal and seat between the container lid 30 and the container body 20 such that, in one non-limiting configuration, an airtight and/or liquidtight seal is created between container lid 30 and container body 20 when in the fully closed and locked position.

Latches 42, 43, and 44 are integrally formed with the outer rim portion 32 of container lid 30. Each of the latches 42, 43, and 44 are illustrated as being connected at or near the top edge of the outer rim portion; however, it can be appreciated that one or more of the latches can be connected between the top and bottom edges or connected at or near the bottom edge of the outer rim portion. As illustrated in FIG. 5, each of the latches includes a pivot channel 42*a*, 43*a*, 44*a* and enables each of the latches to be movable relative to the outer surface of the outer rim portion so that the latches can be moved between the latched and unlatched positions.

Side latches 42 and 44 are illustrated as being similarly configured, whereas front thumb latch 43 has a different configuration; however, this is not required. Front thumb latch 43 is illustrated as being positioned on the opposite side of the container lid from hinge 40; however, this is not required. Side latches 42 and 42 are illustrated as being positioned on the opposite side of the container lid from another and generally equally spaced from hinge 40 and/or front thumb latch 43; however, this is not required. Although the container lid is illustrated as including three latches, it can be appreciated that the container lid can be configured to include only front thumb latch 43. Also, it can be appreciated that the container lid can be configured to include a front thumb latch 43 and a single side latch or more than two side latches.

The front thumb latch 43 that is configured to be releasably secured to a latch connector 45 of container body 20 is illustrated in FIGS. 1, 3 and 4. The first and second side latches 42 and 44 are configured to be releasably secured to the descending wall portion 27 of container body 20 as illustrated in FIGS. 1, 3 and 4. Side latches 42 and 44 are provided with a hook feature 49 that is configured to releasably engage and secure to the descending wall portion 27 of the top flange 25 on the container body. The hook feature 49 is configured to at least partially extend in an upward direction into the gap between the container body sidewall and the descending sidewall portion 27 when the side latch is in the latched position as illustrated in FIG. 3; however, this is not required. The side latches can optionally include one or more latch ribs 68 to provide structural support to the hook feature as illustrated in FIG. 2.

The latches are configured for movement to an open/unlatched position as illustrated in FIG. 2, in which the container lid can be pivoted on hinge 40 between the open and closed position so that materials can be added and/or removed from the container cavity of the container body. The latches are also configured for movement to a locked/latched position as illustrated in FIGS. 1, 3, and 4 in which the container lid is secured in a fully closed and locked position and an airtight and/or liquidtight seal is formed between the container lid and the container body.

The outer surface of one or more latches can include markings as illustrated in FIG. 11; however, this is not required.

Other embodiments may use latches at different locations such as at the corners rather than the middle portion. While the exemplary embodiment illustrated in the accompanying figures employs three latches in the middle of each of the three sides of the lid, other embodiments may employ a fewer or greater number of latches.

The lockable container of the present invention can be designed to accommodate the storage of food items; however, it can be appreciated that the lockable container of the present invention can be designed to accommodate the storage of other items (e.g., office supplies, hardware, pet supplies, pet food, etc.). The lockable container of the present invention has the following advantages 1) the lockable container is relatively inexpensive to manufacture, 2) provides an airtight seal when in a closed position, 3) can be lockable, 4) can be substantially leak-proof, 5) can be microwavable, 6) can be repeatedly and releasably securable, 7) can be easily and conveniently stored, 8) can be configured and/or customized in a variety of shapes and sizes, and/or 9) can be configured and/or customized to accommodate the storage of food items.

The invention has been described with reference to the preferred embodiment and alternatives thereof. It is believed that many modifications and alterations to the embodiment disclosed will readily suggest themselves to those skilled in the art upon reading and understanding the detailed description of the invention. It is intended to include all such modifications and alterations insofar as they come within the scope of the present invention.

What is claimed:

1. A method of sealing materials in a storage container comprising:

providing said storage container, said storage container including:

a container body, said container body including one or more sidewalls forming an interior and exterior sidewall surface and a body cavity between a base of the container body and the one or more sidewalls, and a container lid, said container lid including an outer rim portion, a center window portion and a sealing member disposed between the outer rim portion and the center window portion, said outer rim portion, said center window portion and said sealing member being separately formed components that have been interconnected together, said outer rim portion including a lid hinge and a front latch, said lid hinge is connected to said container body, said lid hinge permitting movement of the container lid relative to the container body between an open and a closed position, said front latch configured to move between an unlatched and latched position, said position of said front latch enabling said front latch to engage said container body and to secure said container lid in a closed and locked position;

placing said materials in said body cavity of said container body;

moving said container lid from said open position to said closed position such that said container lid at least partially overlies an opening of said body cavity; and, moving said front latch from said unlatched position to said latched position to cause said container lid to be in said closed and locked position.

2. The method of claim 1, wherein said front latch is positioned on an opposite side of said container lid from said lid hinge.

3. The method of claim 1, wherein said container lid includes two side latches that are positioned on opposite sides of the container lid from one another, each of said side latches are spaced from said lid hinge and said front latch.

4. The method of claim 1, wherein said container body has a peripheral top surface that encircles an opening in said body cavity, said peripheral top surface including a descending wall portion that is spaced from an outer surface of said sidewall of said container body.

5. The method of claim 4, wherein said top peripheral surface includes a channel formed therein.

6. The method of claim 4, wherein said container body sidewall includes one or more ribs extending between said outer surface of said sidewall to said inner surface of said descending wall portion of said top peripheral surface.

7. The method of claim 1, wherein said sealing member provides an airtight and/or liquidtight seal between said container lid and said container body when said container lid is in a fully closed and locked position.

8. The method of claim 1, wherein said cover window portion of said container lid includes a sealing flange extending downwardly from a bottom surface of said cover window portion, said sealing flange configured to engage an inner surface of said body cavity when said container lid is in said fully closed and lock position.

9. The method of claim 1, including the further step of connecting said lid hinge to said container body prior to fully closing and locking said container lid to said container body.

10. A method of sealing materials in a storage container comprising:

providing said storage container, said storage container including:

a container body, said container body including one or more sidewalls forming an interior and exterior sidewall surface and a body cavity between a base of the container body and the one or more sidewalls, and a container lid, said container lid including an outer rim portion, a center window portion and a sealing member disposed between the outer rim portion and the center window portion, said outer rim portion, said center window portion and said sealing member being separately formed components that have been interconnected together, said sealing member formed of a different material from said center window portion and/or said outer rim portion, said sealing member formed of a more flexible material than said center window portion and/or said outer rim portion, said outer rim portion including a lid hinge, a front latch and two side latches, said lid hinge is non-releasably connected to said container body, said lid hinge permitting movement of the container lid relative to the container body between an open and a closed position, said front latch configured to move between an unlatched and latched position, said position of said front latch enabling said front latch to engage said container body and to secure said container lid in a closed and locked position, each of said side latches is configured to move relative to an outer surface of said outer rim portion between a latched position and an unlatched position, said sealing member forms an airtight and/or liquid-tight seal between said container lid and said container body when said container lid is in a fully closed and locked position, said front latch is positioned on an opposite side of said container lid from said lid hinge;

placing said materials in said body cavity of said container body;

moving said container lid from said open position to said closed position such that said container lid at least partially overlies an opening of said body cavity; and, moving said front latch from said unlatched position to said latched position to cause said container lid to be in said closed and locked position.

11. The method of claim 10, wherein said container body has a peripheral top surface that encircles an opening in said body cavity, said peripheral top surface including a descending wall portion that is spaced from an outer surface of said sidewall of said container body, said top peripheral surface includes a channel formed therein, said container body sidewall includes one or more ribs extending between said outer surface of said sidewall to said inner surface of said descending wall portion of said top peripheral surface.

12. The method of claim 10, wherein said side latches are configured the same and the front latch is configured differently from said two side latches.

13. The method of claim 10, wherein the said outer rim portion, said center window portion, or combinations thereof are formed of an olefin thermoplastic, said sealing member is formed of an elastomeric material, said elastomeric material is silicon or a thermoplastic elastomer, said container body is formed of polycarbonate.

14. The method of claim 10, wherein said cover window portion of said container lid includes a sealing flange extending downwardly from a bottom surface of said cover window portion, said sealing flange configured to engage an inner surface of said body cavity when said container lid is in said fully closed and lock position.

15. The method of claim 10, including the further step of connecting said lid hinge to said container body prior to fully closing and locking said container lid to said container body.

16. A method of sealing materials in a storage container comprising:

providing said storage container, said storage container including:

a container body, said container body including one or more sidewalls forming an interior and exterior sidewall surface and a body cavity between a base of the container body and the one or more sidewalls, and a container lid, said container lid including an outer rim portion, a center window portion and a sealing member disposed between the outer rim portion and the center window portion, said outer rim portion including a lid hinge, a front latch and two side latches, said lid hinge is non-releasably connected to said container body, said lid hinge permitting movement of the container lid relative to the container body between an open and a closed position, said front latch configured to move between an unlatched and latched position, said position of said front latch enabling said front latch to engage said container body and to secure said container lid in a closed and locked position, each of said side latches is configured to move relative to an outer surface of said outer rim portion between a latched position and an unlatched position, said sealing member forms an airtight and/or liquid-tight seal between said container lid and said container body when said container lid is in a fully closed and locked position, said lid hinge includes two pivot grooves, said front latch is positioned on an opposite side of said container lid from said lid hinge, said outer rim portion, said center window portion and said sealing member of said container lid are separately formed components that are securely connected together to form said container lid, said sealing member formed of a different material from one or more components selected from the group consisting of said outer rim portion and said center window portion;

placing said materials in said body cavity of said container body;

moving said container lid from said open position to said closed position such that said container lid at least partially overlies an opening of said body cavity; and, moving said front latch from said unlatched position to said latched position to cause said container lid to be in said closed and locked position.

17. The method of claim 16, wherein said container body has a peripheral top surface that encircles an opening in said body cavity, said peripheral top surface including a descending wall portion that is spaced from an outer surface of said sidewall of said container body, said top peripheral surface includes a channel formed therein, said container body sidewall includes one or more ribs extending between said outer surface of said sidewall to said inner surface of said descending wall portion of said top peripheral surface.

18. The method of claim 17, wherein said side latches are configured the same and the front latch is configured differently from said two side latches.

19. The method of claim 18, wherein the said outer rim portion, said center window portion, or combinations thereof are formed of an olefin thermoplastic, said sealing member is formed of an elastomeric material, said elastomeric material is silicon or a thermoplastic elastomer, said container body is formed of polycarbonate.

20. The method of claim 19, wherein said cover window portion of said container lid includes a sealing flange extending downwardly from a bottom surface of said cover window portion, said sealing flange configured to engage an inner surface of said body cavity when said container lid is in said fully closed and lock position.

21. The method of claim 20, including the further step of connecting said lid hinge to said container body prior to fully closing and locking said container lid to said container body.

* * * * *